US007395019B2

(12) United States Patent
Hattori et al.

(10) Patent No.: US 7,395,019 B2
(45) Date of Patent: Jul. 1, 2008

(54) IMAGE FORMING APPARATUS INCLUDING UNITS FOR RECOVERING DEVELOPING AGENT ADHERING TO DEVELOPING AGENT CARRIERS

(75) Inventors: Tomoaki Hattori, Nagoya (JP); Yukiko Nakaya, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/931,389

(22) Filed: Oct. 31, 2007

(65) Prior Publication Data

US 2008/0063436 A1 Mar. 13, 2008

Related U.S. Application Data

(62) Division of application No. 11/237,802, filed on Sep. 29, 2005, now Pat. No. 7,308,214.

(30) Foreign Application Priority Data

Sep. 30, 2004 (JP) ..... 2004-286538
Sep. 30, 2004 (JP) ..... 2004-287443

(51) Int. Cl.
*G03G 15/01* (2006.01)
*G03G 15/08* (2006.01)

(52) U.S. Cl. ..... 399/283; 399/254; 399/285

(58) Field of Classification Search ..... 399/283, 399/273, 285, 254, 149, 150, 53, 55, 223
See application file for complete search history.

(56) References Cited

U.S. PATENT DOCUMENTS 6,032,012 A 2/2000 Hirono et al.
6,721,522 B2 4/2004 Kakeshita
6,950,620 B2 9/2005 Yoshikawa et al.
2004/0228656 A1 * 11/2004 Kamimura ..... 399/149

FOREIGN PATENT DOCUMENTS

JP 5-053482 A 3/1993
JP 2002-031933 A 1/2002

* cited by examiner

*Primary Examiner*—Sophia S Chen
(74) *Attorney, Agent, or Firm*—Banner & Witcoff, Ltd.

(57) ABSTRACT

An image forming apparatus includes: a plurality of development units having developing-agent carriers which are provided in correspondence to three or more developing agents, and developing electrostatic latent images on surfaces of image carriers to form developing-agent images on the image carriers; and a recovery unit that recovers the developing agent adhering to the developing-agent carrier during non-development operation. The recovery unit is provided for at least the development unit other than the development unit that transfers the developing-agent image first in sequence among the plurality of development units. When one of the plurality of development units performs development by the developing agent whose charge capability is higher than that of the developing agent of the development unit that transfers the developing-agent image later in sequence, the recovery unit starts recovery of the developing agent or performs recovery operation for improving recovery capability of the developing agent.

12 Claims, 10 Drawing Sheets

FIG. 4

| EASE OF OCCURRENCE OF REVERSE TRANSFER | ON THIRD DEVELOPMENT UNIT | ON FOURTH DEVELOPMENT UNIT |
|---|---|---|
| LOW | FIRST TONER + SECOND TONER ⇒REVERSE TRANSFER OF SECOND TONER | SECOND TONER + THIRD TONER ⇒REVERSE TRANSFER OF THIRD TONER |
| MEDIUM | | FIRST TONER + SECOND TONER ⇒REVERSE TRANSFER OF SECOND TONER |
| HIGH | | FIRST TONER + THIRD TONER ⇒REVERSE TRANSFER OF THIRD TONER |

"d" OF FOURTH DEVELOPMENT UNIT < "d" OF FIRST TO THIRD DEVELOPMENT UNITS

V1 = FIRST TO FOURTH DEVELOPMENT UNITS: + 400V

V2 { FIRST TO THIRD DEVELOPMENT UNITS: + 500V
FOURTH DEVELOPMENT UNIT: + 400V

IMAGE FORMING APPARATUS INCLUDING UNITS FOR RECOVERING DEVELOPING AGENT ADHERING TO DEVELOPING AGENT CARRIERS

CROSS REFERENCE TO RELATED APPLICATIONS

This application is a divisional of prior U.S. application Ser. No. 11/237,802, filed Sep. 29, 2005, now U.S. Pat. No. 7,308,214, which application claims priority to Japanese application nos. 2004-286538, filed Sep. 30, 2004 and 2004-287443, filed Sep. 30, 2004, the entire contents of which are incorporated herein by reference.

BACKGROUND OF THE INVENTION

1. Field of the Invention

The present invention relates to an image forming apparatus which forms a multicolor image by transferring, onto a material on which images are to be transferred (hereinafter called a "transfer-target material"), images sequentially formed on image carriers through use of a developing agent by means of a plurality of development units.

2. Description of the Related Art

In a hitherto-known image forming apparatus, images are sequentially formed, by use of a developing agent, on surfaces of a plurality of image carriers (a single image carrier in the case of a so-called four-cycle system), on each of which an electrostatic latent image is formed, by use of a plurality of development units. These images formed by use of the developing agent (such images will be called "developing-agent images" throughout the specification) are sequentially transferred onto a transfer-target material, such as paper or an intermediate transfer element, in a superimposed manner to thus form a multicolor image (see JP-A-2002-31933).

In such an image forming apparatus, when the developing-agent image formed on the image carrier is transferred to a transfer-target material, a portion of the developing agent forming the developing-agent image is not transferred and remains on the image carrier. The developing agent (a waste developing agent) adhering to the image carrier after transfer of such a developing-agent image becomes a "post-transfer residual ghost" which is transferred to a location other than that of an originally-intended image, thereby adversely affecting formation of an image after one rotation of the image carrier. In order to prevent exertion of adverse effect on formation of an image, which would otherwise be caused by such a waste developing agent, a known image forming apparatus is provided with a cleaner which is placed so as to oppose the image carrier and scrapes off the waste developing agent.

As an image forming apparatus for which an attempt has been made to achieve miniaturization and cost cutting without use of the cleaner, there is known an image forming apparatus which adopts a synchronous development-and-cleaning system, wherein an electrostatic latent image on the surface of an image carrier is developed by use of a development unit, and a waste developing agent adhering to an area other than the electrostatic latent image from the image carrier is recovered (see Japanese Patent No. 3154757).

This synchronous development-and-cleaning system corresponds to a method for recovering the waste developing agent adhering to the location other than the electrostatic latent image with use of the development unit through adsorption and by utilization of the fact that an area on the surface of the image carrier, except the location where the electrostatic latent image is formed, becomes higher in electric potential than the development unit.

SUMMARY OF THE INVENTION

However, when a multicolor image is formed by use of the image forming apparatus as disclosed in JP-A-2002-31933, a second image carrier and subsequent image carriers, from which the developing-agent images are transferred to transfer-target materials, have as waste developing agents a developing agent adhering to the transfer-target material through reverse transfer in addition to developing agents fixedly remaining on the image carrier as a result of transfer.

Here, the word "reverse transfer" means the following phenomenon. Developing agents charged to a polarity opposite that charged by a development unit (reversely-charged developing agents) arise in a portion of the developing-agent image and has been transferred from the image carrier to the transfer-target material. For this reason, when the developing-agent image is transferred to a transfer-target material by means of an image carrier on which a developing-agent image is to be formed, the reversely-charged developing agent is transferred from a transfer-target material to an image carrier in a direction opposite the direction of ordinary transfer operation.

Here, for example, when the charging capacity of a developing agent developed by a development unit, on which a developing-agent image is to be formed first, is greater (in terms of the absolute value of the amount of electrostatic charge) than that of developing agent used for development by a second or subsequent development unit, a phenomenon called background fog sometimes arises in the respective second and subsequent development units. Specifically, when a developing agent having high charging capability is reversely transferred from an upstream development unit among the second and subsequent development units, the thus-reversely-transferred, highly-charged developing agent (having a high absolute value of the amount of electrostatic charge) migrates to a developing-agent carrier at a nip point existing between the image carrier and the developing-agent carrier, and the thus-migrating developing agent is accumulated on the surface of the developing-agent carrier.

Therefore, development is carried out while the thus-accumulated, highly-charged developing agent is mixed with a developing agent supplied by the developing-agent carrier, thereby causing a mixture of colors. By means of frictional charge induced by the highly-charged developing agent, a portion of the developing agent supplied by the developing-agent carrier is changed to a polarity opposite the original charged polarity, because of a difference in charging capability (a difference in the amount of electrostatic charge). The developing agent whose polarity has been inverted adheres to an area outside the region of the image carrier for an electrostatic latent image, thereby causing so-called background fog.

The present invention provides an image forming apparatus that forms an image while suppressing the influence of reverse transfer.

Such reverse transfer tends to easily arise as the amount of developing agent (the amount of toner) transferred to the transfer-target material becomes larger. For instance, in the case of an image forming apparatus of tandem system, an image carrier arranged downstream in a transporting direction of paper generally reversely transfers a larger amount of developing agent.

However, an image forming apparatus of so-called synchronous development-and-cleaning system (also called as a cleaner-less system) as disclosed in Japanese Patent No. 3154757 has no cleaning device specifically designed to recover a waste developing agent. The thus-reversely-transferred waste developing agent migrates to a developing-agent carrier at a nip point between the image carrier and the developing-agent carrier, so that the waste developing agent is accumulated on the surface of the developing-agent carrier. Therefore, development is effected while the highly-charged, accumulated waste developing agent (reversely-transferred toner) is mixed with the developing agent supplied by the developing-agent carrier, thereby resulting in occurrence of mixing of colors. Particularly, when a difference in charge capability exists between the reversely-transferred waste developing agent (reversely-transferred toner) and the developing agent supplied by the developing-agent carrier (when the reversely-transferred toner is higher than the supplied toner in terms of the absolute value of the amount of electrostatic charge), the reversely-transferred waste developing agent more actively takes part in development operation. Therefore, a problem of mixing of colors, such as that mentioned above, is likely to arise.

Also, by means of frictional charge arising between the supplied developing agent and the highly-charged, reversely-transferred waste developing agent, some of the supplied developing agent is changed to a polarity opposite an original charge polarity, for reasons of the difference in charge capabilities (the difference in the amounts of electrostatic charge). The developing agent whose polarity has been inverted adheres to an area of the image carrier outside the region of an electrostatic latent image, thereby raising another problem; namely, occurrence of so-called background fog.

Conversely, when the reversely-transferred waste developing agent (the reversely-transferred toner) has become degraded (in terms of charge capability), the waste developing agent is easily changed to the opposite polarity as a result of occurrence of frictional charge between the supplied developing agent and the reversely-transferred developing agent. In this case, there may be a chance of the waste developing agent (reversely-transferred toner) causing background fog to thus deteriorate the quality of an image.

A conceivable way of solving the problem is to provide the image forming apparatus with a cleaning device specifically designed for recovering a waste developing agent (the transferred residual toner and the reversely-transferred toner) adhering to the image carrier after transfer operation, thereby preventing the waste developing agent from adhering to the developing-agent carrier. However, addition of a specifically-designed cleaning device yields a problem of an increase in the size of the apparatus and a cost hike. Even in a case where a specially-designed cleaning device is available, if a sufficient cleaning effect is not exhibited, there may arise a chance of mixing of colors or background fog arising in the same manner as in the case of the image forming apparatus of synchronous development-and-cleaning system.

The present invention provides an image forming apparatus that can prevent exertion of adverse influence on formation of an image, which would otherwise be caused by a waste developing agent adhering to a developing agent carrier through reverse transfer, without involvement of an increase in the size of the apparatus and a cost.

According to an aspect of the present invention, there is provided an image forming apparatus including: image carriers, on whose surfaces electrostatic latent images are formed; a plurality of development units having developing-agent carriers which are provided in correspondence to three or more developing agents and which carry the respective developing agents, and developing the electrostatic latent images on the surfaces of the image carriers by the developing-agent carriers to form developing-agent images on the image carriers; and recovery units that recover the developing agents adhering to the developing-agent carriers during non-development operation, wherein an image is formed by sequentially transferring the developing-agent images formed on the image carriers to a transfer-target material, the recovery units are provided for at least the development units that are other than first in sequence of formation of a developing-agent image among the plurality of development units, and when one of the plurality of development units performs development by the developing agent whose charge capability is higher than that of the developing agent of the development unit whose sequence of formation of a developing-agent image is later, the recovery unit starts recovery of the developing agent or performs recovery operation for improving recovery capability of the developing agent.

The expression "three developing agents or more" encompasses developing agents of the same color as well as developing agents of different colors.

The expression "transfer-target material" may refer to an intermediate transfer element, such as an intermediate transfer belt or an intermediate transfer drum, as well as a recording medium such as paper or an OHP sheet.

The term "image forming apparatus" may refer to a multifunction machine having the function of a facsimile, the function of a printer, and the function of a scanner, as well as a printing machine such as a printer (a laser printer). The image forming apparatus is not limited to an image forming apparatus of tandem system having image carriers for respective development units, but may be an image forming apparatus of four-cycle system wherein respective development units perform development for a common image carrier.

The term "during non-development operation" means a time during which the development unit does not perform developing operation. For instance, the term means a time before or after image-forming operation or an interim period between operations for forming images on recording mediums which are sequentially performed. Moreover, the term includes a time during which the developing-agent carrier opposes a portion of the image carrier other than a region where an electrostatic latent image is to be formed.

The term "recovery operation" may be a configuration, wherein recovery operation is performed for all of the development units having the recovery unit. Alternatively, the term means a configuration, wherein recovery operation is performed for all or portions of development units which are later than the one development unit in sequence of formation of a developing-agent image.

The term "sequence of formation of the developing-agent image" means a sequence of development units arranged in the moving direction of a material on which an image is transferred relative to those development units, in the case of an image-forming apparatus of, e.g., a tandem system.

According to the present configuration, recovery operation is performed (the recovery unit starts recovery of a developing agent, or recovery capability of the recovery unit is improved in relation to that under normal conditions) on condition that one of a plurality of development units performs development through use of a developing agent whose charge capability is higher than that of a development unit that is later than the one development unit in sequence of formation of a developing-agent image.

As a result, in a development unit which is later than the one development unit in sequence of formation of a developing-agent image, the developing agent having high charge capability is recovered by means of performing a recovery operation even when the developing agent has been reversely transferred. In consequence, occurrence of mixing of colors or background fog can be prevented.

According to another aspect of the invention, there is provided an image forming apparatus including: image carriers, on whose surfaces electrostatic latent images are formed; a plurality of development units having developing-agent carriers which are provided in correspondence to three or more developing agents and which carry the respective developing agents, and developing the electrostatic latent images on the surfaces of the image carriers by the developing-agent carriers to form developing-agent images on the image carriers; and recovery units that recover the developing agents adhering to the developing-agent carriers during non-development operation, wherein an image is formed by sequentially transferring the developing-agent images formed on the image carriers to a transfer-target material, the recovery units are provided for at least the development units that are other than first in sequence of formation of a developing-agent image among the plurality of development units, and when any of the plurality of development units other than the development unit that is last in sequence of formation of a developing-agent image has been subjected to replacement of a developing agent, the recovery unit starts recovery of the developing agent or performs recovery operation for improving recovery capability of the developing agent.

The exchanged developing agent of the development unit is usually higher in charge capability than the developing agent of another development unit. Mixing of colors or background fog, which would otherwise be caused by reverse transfer, is likely to arise in the other development unit. Accordingly, according to the present configuration, the recovery operation is performed on condition that a developing agent of any of the development units has been exchanged.

According to still another aspect of the invention, there is provided an image forming apparatus including: image carriers, on whose surfaces electrostatic latent images are formed; a plurality of development units which are provided in correspondence to different colors, which have developing-agent carriers that carry developing agents of corresponding colors, and which develop the electrostatic latent images on the surfaces of the image carriers through use of the developing agents by the developing-agent carriers; and recovery units which are provided for the respective development units and which recover the developing agents adhering to the respective developing-agent carriers upon contact with the developing-agent carriers after the image carriers have been subjected to development, wherein developing-agent images are sequentially formed on the image carriers by developing the electrostatic latent images by the respective development units, and the developing-agent images are transferred to a transfer-target material, thereby forming a multi-color image, and recovery capabilities of the respective recovery units are determined such that the development unit which is last in sequence of formation of a developing-agent image is higher in recovery capability than at least the development unit which is first in sequence of formation of the developing-agent image, and such that recovery capability of one development unit is higher than recovery capability of another development unit which is immediately before the one development unit in sequence of formation of the developing-agent image.

In the image forming apparatus which forms the multicolor image, only the developing agent which is a remaining of transfer adheres, as a waste developing agent, to the developing-agent carrier which is first in sequence of formation of the developing-agent image. However, in addition to the developing agent which adheres to the developing-agent carrier as the remaining of transfer, a reversely-charged developing agent having arisen in a portion of the developing-agent image transferred to the transfer-target material adheres, through reverse transfer, to the developing-agent carrier which is second to last in sequence of formation of the developing-agent image. For this reason, the waste developing agent adhering to the developing-agent carrier that is second to last in sequence of formation of a developing-agent image is greater in quantity than the waste developing agent adhering to the developing-agent carrier that is first in sequence of formation of a developing-agent image. Moreover, reverse transfer tends to easily arise as the amount of developing agent (i.e., the amount of toner) transferred to the transfer-target material increases. For this reason, in the case of a developing-agent carrier which is later in sequence of formation of a developing-agent image, the amount of developing agent reversely transferred increases. Correspondingly, the amount of waste developing agent (i.e., the quantity of reversely-transferred toner) adhering to the developing-agent carrier also increases.

For this reason, according to this configuration, the development unit that is last in sequence of formation of a developing-agent image is higher than the development unit that is first in sequence of formation of a developing-agent image, in view of recovery capability (so-called scraping capability) of the recovery unit. Each of the development unit is greater than an immediately-preceding development unit in sequence of formation of a developing-agent image in view of recovery capability (the recovery capability of each development unit is made equal to or in excess of the recovery capability of an immediately-preceding development unit). Accordingly, the development unit having high capability of recovering a waste developing agent can recover a waste developing agent from the developing-agent carrier which is second to last in sequence of formation of a developing-agent image, thereby preventing occurrence of mixing of colors or background fog.

Another conceivable configuration is to improve the recovery capabilities of all of the development units. However, such a configuration entails an increase in drive load of a recovery mechanism for all of the development units. In association with the increase in drive load, a larger drive source is required, which may in turn lead to an increase in cost and the size of an apparatus. Therefore, in the above-described image forming apparatus, a configuration for improving the recovery capability of one of the plurality of development units is employed.

According to still another aspect of the invention, there is provided an image forming apparatus including: image carriers, on whose surfaces electrostatic latent images are formed; a plurality of development units which are provided in correspondence to different colors; which have developing-agent carriers that carry developing agents of corresponding colors; and which develops the electrostatic latent images on the surfaces of the image carriers through use of the developing agents by the developing-agent carriers; and an agitation member provided to each of the development units, for agitating the developing agent in a developing-agent storage chamber that stores the developing agent, wherein developing-agent images are sequentially formed on the image carriers by developing the electrostatic latent images by the respective development units, and the developing-agent images are transferred to a transfer-target material, thereby forming a multi-color image, and agitation capabilities of the respective agitation members are determined such that the development unit which is last in sequence of formation of a developing-agent image is higher in agitation capability than at least the development unit which is first in sequence of formation of the developing-agent image and such that one development unit is higher in agitation capability than another development unit which is immediately before the one development unit in sequence of formation of the developing-agent image.

In an image forming apparatus which forms a multicolor image, only a developing agent which is a residue of transfer adheres, as a waste developing agent, to a developing-agent carrier which is first in sequence of formation of a developing-agent image. However, in addition to the developing agent which adheres to the developing-agent carrier as a residue of transfer, a reversely-charged developing agent having arisen in a portion of the developing-agent image transferred to the transfer-target material adheres, through reverse transfer, to the developing-agent carrier which is second to last in sequence of formation of a developing-agent image. For this reason, the waste developing agent adhering to the developing-agent carrier that is second to last in sequence of formation of a developing-agent image is greater in quantity than the waste developing agent adhering to the developing-agent carrier that is first in sequence of formation of a developing-agent image. This waste developing agent may cause mixing of colors when developed in conjunction with the developing agent of the developing-agent carrier.

When a difference exists between the charge capability of the reversely-transferred waste developing agent (reversely-transferred toner) and the developing agent supplied by the developing-agent carrier (when the reversely-transferred toner is higher than the supplied toner in terms of the absolute value of the amount of electrostatic charge), some of the supplied developing agent is changed to a polarity opposite an original charge polarity by means of frictional charge arising between the supplied developing agent and the highly-charged, reversely-transferred waste developing agent, for reasons of the difference in charge capabilities (the difference in the amounts of electrostatic charge). The developing agent whose polarity has been inverted adheres to an area of the image carrier outside the region of an electrostatic latent image, thereby raising another problem; namely, occurrence of so-called background fog.

When the developing agent which has been changed to a polarity opposite the original charge polarity is in trace amount, the chance of the quality of an image being adversely affected as a result of occurrence of a "fog" is low. However, as the amount of reversely-transferred waste developing agent (reversely-transferred toner) is large, the amount of developing agent charged to an opposite polarity is also increased correspondingly. Consequently, the "fog" becomes noticeable.

For this reason, according to this configuration, the development unit that is last in sequence of formation of a developing-agent image is made higher than the development unit that is first in sequence of formation of a developing-agent image, in view of the agitation capability of agitation member; and each of the development units is greater than an immediately-preceding development unit in sequence of formation of a developing-agent image in view of agitation capability (the agitation capability of each development unit is made equal to or in excess of the agitation capability of an immediately-preceding development unit). Accordingly, in relation to the developing-agent carrier which is second to last in sequence of formation of a developing-agent image, the development unit having high agitation capability efficiently disperses the reversely-transferred developing agent in the developing-image storage chamber by the development unit having high agitation capability, thereby preventing occurrence of mixing of colors or background fog.

In another conceivable configuration, the agitation capabilities of all of the development units are improved. However, such a configuration entails an increase in drive load of an agitation mechanism for all of the development units. In association with the increase in drive load, a larger drive source is required, which may in turn lead to n increase in cost and the size of an apparatus. Therefore, the configuration for improving the agitation capability of one of the plurality of development units is employed.

BRIEF DESCRIPTION OF THE DRAWINGS

The present invention may be more readily described with reference to the accompanying drawings:

FIG. 4 is a descriptive view for describing the sequence in which an image is formed by a developing agent and ease of occurrence of reverse transfer;

DETAILED DESCRIPTION OF THE PREFERRED EMBODIMENTS

First Embodiment

A first embodiment of the present invention will be described with reference to FIGS. 1 to 4.

1. Configuration of a Color Laser Printer

Figure 1:
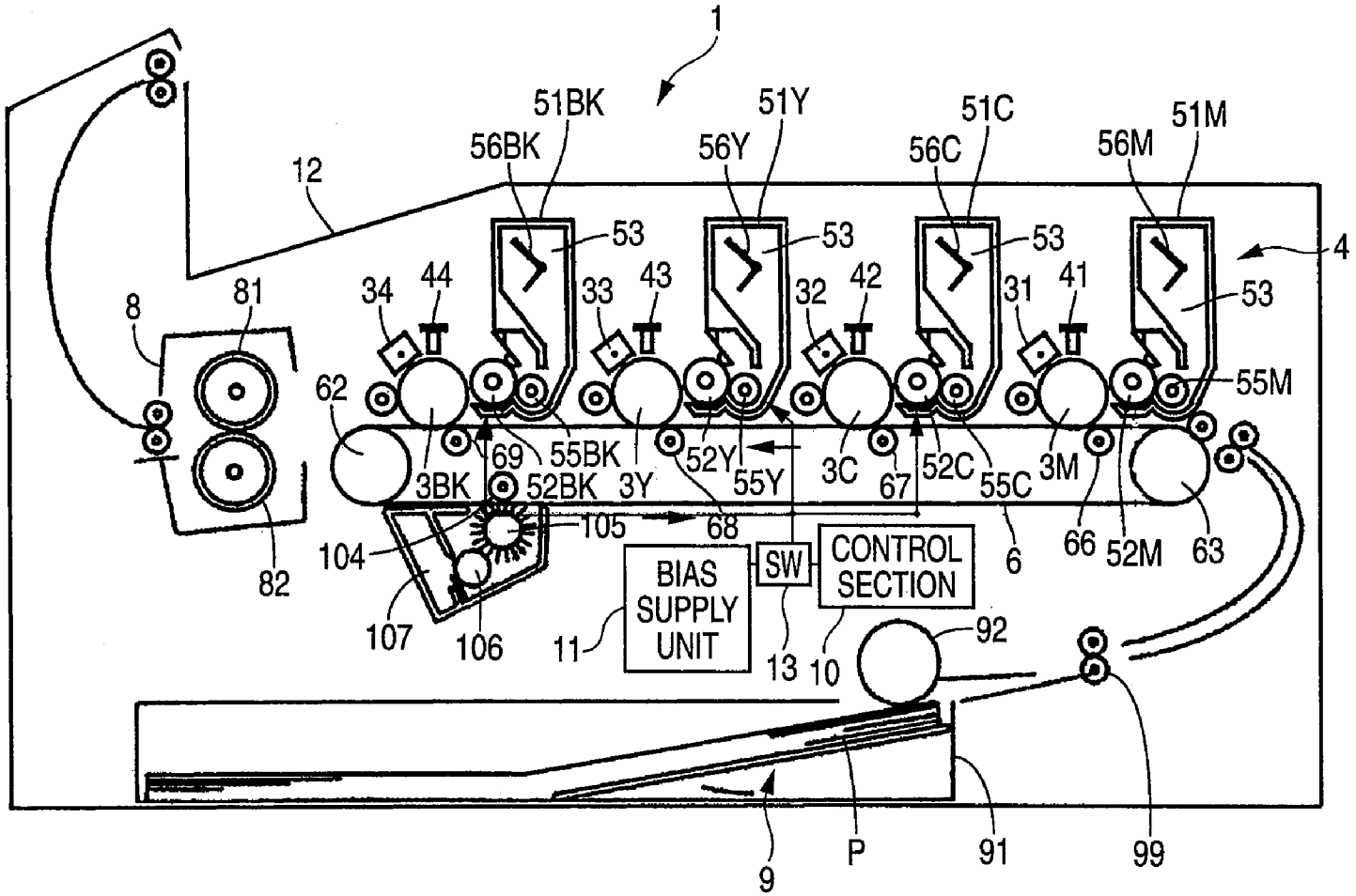
FIG. 1 is a side cross-sectional view showing a diagrammatic configuration of a color laser printer according to a first embodiment of the present invention.

FIG. 1 is a side cross-sectional view showing a diagrammatic configuration of a color laser printer 1 serving as an image forming apparatus to which the present invention is applied. As shown in FIG. 1, the color laser printer 1 (image forming apparatus) of the present embodiment includes a visible-image-forming section 4; a paper transport belt 6; a fixing section 8; a paper-feeding section 9; a stacker 12; a control section 10; and a bias supply unit 11. Toner images of four colors (images formed by use of a developing agent) corresponding to the image data input from the outside are sequentially formed on the paper P (a transfer-target material, a recording medium), whereby a multicolor image is formed.

(1) Visible-Image-Forming Section

The visible-image-forming section 4 includes four development units 51 (51M, 51C, 51Y, 51BK); four photosensitive drums 3 (3M, 3C, 3Y, 3BK: image carriers) provided in correspondence to the respective development units 51M, 51C, 51Y, and 51BK; four charge devices 31, 32, 33, and 34 provided in correspondence to the respective development units 51M, 51C, 51Y, and 51BK; and four exposure devices 41, 42, 43, and 44 provided in correspondence to the respective development units 51M, 51C, 51Y, and 51BK. Magenta (M) toner, cyan (C) toner, yellow (Y) toner, and black (BK) toner (corresponding to three or more developing agents of the present invention) are stored in the respective development units 51M, 51C, 51Y, and 51BK. More specifically, letters affixed to reference numerals denoting the respective development units in FIG. 1 depict colors of toner housed in the respective development units. Paper P undergoes development in sequence of magenta (M), cyan (C), yellow (Y), and black (BK).

The configuration of respective constituent elements will be described in detail hereunder.

(a) Photosensitive Drum

Each of the four photosensitive drums 3M, 3C, 3Y, 3BK which together constitute the visible-image-forming section 4 is formed from an essentially-cylindrical member. These cylindrical members are arranged at essentially uniform intervals along a horizontal direction (a horizontal direction in FIG. 1) in a rotatable manner. For instance, substrates which are made from aluminum and coated with a positively-charge photosensitive layer are used as the essentially-cylindrical members of the respective photosensitive drums 3M, 3C, 3Y, and 3BK. The substrates made from aluminum are connected to a ground line of the color laser printer 1.

(b) Charge Devices

The four charge devices 31 to 34 are charge devices of so-called scorotron type. Of these charge devices, the charge device 31 for charging the photosensitive drum 3M, on which a magenta toner image is formed, has a detailed configuration such as that shown in FIG. 2. The charge device 31 includes an charge wire 36 which is provided opposite the photosensitive drum 3M and extends in the widthwise direction thereof (the direction perpendicular to the sheet of FIG. 2); and a shielding case 37 which houses the charge wire 36 and whose side opposing the photosensitive drum 3M is opened. The surface of the photosensitive drum 3M is positively charged (to, e.g., +700 V) by application of high voltage to the charge wire 36. The shielding case 37 assumes a structure in which a grid 38 is provided in the opening opposing the photosensitive drum 3M. The surface of the photosensitive drum 3M is maintained at essentially the same electric potential as that of the grid 38, by application of a constant voltage to the grid 38. The respective charge devices 32 to 34 provided so as to oppose the other photosensitive drums 3C, 3Y, and 3BK assume completely the same configuration as that of the charge device 31 shown in FIG. 2.

(c) Exposure Device

Figure 2:
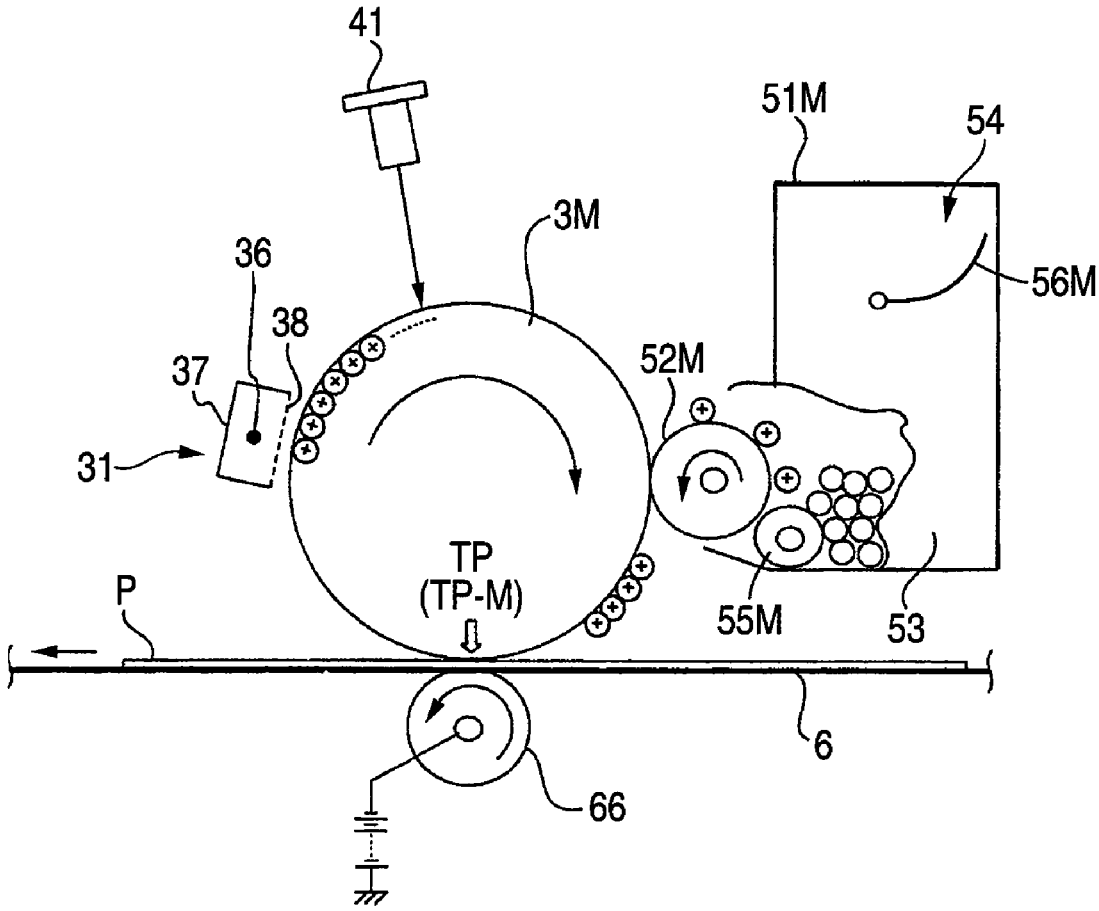
FIG. 2 is a schematic view showing the configuration of a neighborhood of a photosensitive drum.

In relation to the four exposure devices 41 to 44, the exposure device 41 for exposing the photosensitive drum 3M, on whose surface magenta toner is formed, is described as a typical exposure device, by reference FIG. 2. As illustrated, the exposure device 41 is disposed downstream of the charge device 31 with respect to the rotating direction (a clockwise direction in the drawing) of the photosensitive drum 3M. The exposure device 41 emits a laser beam corresponding to image data of one color (magenta in this embodiment) input from the outside from the light source. The laser beam is caused to scan by means of mirror surfaces of a polygon mirror (omitted from the drawings) rotationally driven by a polygon motor (omitted from the drawings), to thus radiate the laser beam on the surface of the photosensitive drum 3M. The majority of the exposure devices 41 to 44 shown in FIGS. 1 and 2 are omitted from the drawings, and only the portions of the exposure devices, from which a laser beam is finally emitted, are illustrated.

The laser beam emitted from the exposure device 41 is radiated on the surface of the photosensitive drum 3M, whereupon the surface potential of the exposed area drops (to, e.g., +150 V). As a result, an electrostatic latent image is formed on the surface of the photosensitive drum 3M. Each of the exposure devices 42 to 44 provided so as to oppose the other photosensitive drums 3C, 3Y, and 3BK has a configuration totally identical with that of the above-described exposure device 41. On the basis of the externally-input image data, laser beams corresponding to respective colors are emitted.

(d) Development Unit

In relation to the four development units 51M, 51C, 51Y, and 51BK, the development unit 51M which develops the electrostatic latent image with magenta toner will be described, as a typical development unit, by reference to FIG. 2.

As illustrated, the development unit 51M has, within a development unit case 53 for housing magenta toner, a toner hopper 54 (a developing agent storage chamber) serving as a toner storage section; a feeding roller 55M serving as a toner feed member and a toner recovery member; and a development roller 52M serving as a developing-agent carrier.

Of these elements, the toner hopper 54 is formed as an internal space of the development unit case 53. The toner hopper 54 is provided with an agitator 56M which is located on the side close to the development roller 52M and serves as an agitation member, and magenta toner is housed in the toner hopper 54. The toner housed in this toner hopper 54 is a positively-charged nonmagnetic mono-component developing agent, is manufactured through suspension polymerization or emulsion polymerization, assumes an essentially-spherical shape, and is superior in fluidity.

The feeding roller 55M is disposed on the lower side of the toner hopper 54, and a metal roller shaft is coated with a roller portion made of a conductive sponge member (conductor). The feeding roller 55M is supported by the nip section that opposes and contacts the development roller 52M, so as to be rotatable in a direction opposite the rotating direction of the development roller 52M (i.e., a counterclockwise direction in FIG. 2).

The "conductor" may include a contact-type conductor which comes into contact with a developing-agent carrier and to which a d.c. bias voltage is applied, or a non-contact-type conductor which is separated from the developing-agent carrier and to which an a.c. bias voltage is applied. Alternatively, the conductor may include a conductor to which a bias voltage is not applied directly during development but to which a recovery bias voltage is applied during recovery operation, or a conductor to which a supply bias voltage is applied during development or a conductor to which a recovery bias voltage is applied during recovery operation.

The development roller 52M is rotatably disposed at a position, where the development roller 52M opposes and contacts the feeding roller 55M, beside the feeding roller 55M. The development roller 52M is formed into a columnar shape by taking conductive silicone rubber as a base material, and fluorine-containing resin or a coating layer of rubber material is formed on the surface of the development roller 52M.

The development roller 52M is disposed downstream of the exposure device 41 with respect to the rotational direction of the photosensitive drum 3M, so as to come into contact with the photosensitive drum 3M. This development unit 51M (positively) charges toner (denoted by "+" in the figure)

and feeds the toner in the form of a uniform thin layer to the development roller 52M. The "+" (positive) electrostatic latent image formed on the photosensitive drum 3M is developed with the "+" (positively) charged toner by means of a reverse development method, at the nip section existing between the development roller 52M and the photosensitive drum 3M, thereby forming a toner image.

Other than housing toner of different colors, the other development units 51C, 51Y, and 51BK have the same configuration as that of the development unit 51M shown in FIG. 2, and cyan toner, yellow toner, and black toner are housed in the development units 51C, 51Y, and 51BK.

(2) Paper-Feeding Section

The paper-feeding section 9 is provided in the lowermost section of the color laser printer 1, and includes a housing tray 91 for housing paper P and a pickup roller 92 for feeding the paper P. The paper P housed in the housing tray 91 is fed one sheet at a time from the paper-feeding section 9 by means of the pickup roller 92, and the thus-fed paper P is delivered to the paper transport belt 6 by way of a transport roller 99 or the like.

(3) Paper Transport Belt

The paper transport belt 6 is configured in an endless manner so as to become narrower than the width of the respective photosensitive drums 3 and to integrally travel while carrying the paper P on the upper surface thereof, and is passed around a drive roller 62 and a follower roller 63. Four transfer rollers 66, 67, 68, 69 are provided so as to oppose the respective photosensitive drums 3 and such that the paper transport belt 6 is sandwiched between the transfer rollers 66, 67, 68, and 69 and the respective photosensitive drums 3.

By means of rotation of the drive roller 62, the surface of the paper transport belt 6 opposing the respective photosensitive drums 3 (hereinafter simply called a "surface of the paper transport belt 6") moves from right to left in the drawing, as shown in FIG. 1. The paper P sent by way of the transport roller 99 or the like is sequentially transported between the respective photosensitive drums 3 and the surface of the paper transport belt 6 and sent to the fixing section 8.

As a result of application, to the charge devices 31 to 34, of a voltage of polarity (i.e., a negative polarity) opposite a polarity (a positive polarity in this embodiment) used for charging the respective photosensitive drums 3, an appropriate transfer bias is applied between the four transfer rollers 66, 67, 68, 69 and the respective photosensitive drums 3 through so-called constant current control (of, e.g., −10 to −15 μA). By means of this transfer bias, the toner images formed on the respective photosensitive drums 3 are sequentially, electrostatically transferred to the paper P by the paper transport belt 6.

For example, in the case of a toner image made from magenta toner, a transfer bias is imparted by application to the transfer roller 66 of a high voltage of negative polarity, as shown in FIG. 2. As a result, the toner image on the photosensitive drum 3M is transferred to the paper P at the position where this photosensitive drum 3M opposes the transfer roller 66; that is, a transfer nip section TP where the paper P comes into contact with the photosensitive drum 3M.

Namely, an electric field develops from the photosensitive drum 3M to the transfer roller 66 by application of the transfer bias. By means of this electric field, the toner image of positive polarity on the photosensitive drum 3M is electrostatically transferred to the paper P. This also applies, in a completely identical manner, to transfer of toner images on the other respective photosensitive drums 3C, 3Y, and 3BK. Toner images of corresponding colors are sequentially transferred onto the paper P by application of the transfer bias to the respective opposing transfer rollers 67 to 69. Thus, as a result of the toner images of four colors being transferred onto the paper P in a superimposing manner in color sequence of magenta, cyan, yellow, and black, a desired multicolor image is formed. Constant current control of a transfer bias is a mere example. A control method may be determined appropriately by adopting, e.g., constant voltage control.

A cleaning brush 105 is provided so as to face the surface of the paper transport belt 6 rolled downward by the drive roller 62. This cleaning brush 105 has a configuration such that a brush is provided on a circumference of an essentially-cylindrical member extending in the widthwise direction of the paper transport belt 6. The cleaning brush 105 is provided to rotate while remaining in contact with the paper transport belt 6 when bias voltage used for inducing a predetermined electrical potential is applied between the cleaning bush 105 and an electrode roller 104 disposed at a position opposing the cleaning brush 105 with the paper transport belt 6 sandwiched therebetween. A recovery roller 106 for recovering the toner adhering to the cleaning brush 105 and a storage box 107 for storing the toner removed from the cleaning brush 105 by the recovery roller 106 are provided in the vicinity of the cleaning brush 105.

(4) Fixing Section

The fixing section 8 includes a heating roller 81 and a pressure roller 82. The paper P carrying the multicolor image formed from toner images of four colors is subjected to heating and pressurization while being nipped and transported by the heating roller 81 and the pressure roller 82, thereby fixing the multicolor image on the paper P.

(5) Stacker

The stacker 12 is formed in the upper surface of the color laser printer 1. This stacker 12 is provided on a paper-output-side of the fixing section 8 and receives the paper P output from the fixing section 8.

(6) Control Section

The control section 10 includes a controller using a known CPU, and controls the overall operation of the color laser printer 1. By controlling the bias supply unit, the control section controls a development bias (e.g., 400 V) applied to the respective development rollers 52 (52M, 52C, 52Y, and 52BK), the transfer bias applied to the respective transfer rollers 66 to 69, the cleaning bias applied between the electrode roller 104 and the cleaning brush 105, and voltages applied to the respective charge devices 31 to 34. As mentioned above, the bias supply unit 11 supplies the respective biases, or the like, to predetermined objects in accordance with a control signal from the control section 10.

As will be described later, in the present embodiment, the control section 10 also functions as an electrostatic charge quantity (charging capability) estimation unit and a recovery bias control unit for controlling application and disconnection of a recovery bias to the supply roller 55.

The color laser printer 1 of the present embodiment is configured as a so-called synchronous development-and-cleaning system, wherein, after transfer of the toner images from the respective photosensitive drums 3 to the paper P, toner having not been transferred and still remaining on the surface of the photosensitive drum 3 is recovered into the toner hopper 54 by way of the development roller 52 and the feeding roller 55.

2. Reverse Transfer

An accurate mechanism of reverse transfer has not yet been revealed. However, as a result of repeated verification of a cause of reverse transfer; more specifically, a cause for reversely charging toner, an inference has been acquired.

First, reverse charge is caused by a discharge in the toner layer transferred on the paper P. This discharge within the toner layer is induced by an intensive electric field arising between the surface potential (e.g., 700 V) of the photosensitive drums 3M, 3C, 3Y, and 3BK and the electric potential of the transfer rollers 66 to 69 (a transfer bias of, e.g., −1 kV). When toner of respective colors is sequentially transferred, the toner on the paper P is stacked into a multiple of layers. Therefore, the amount of electrostatic charge (a positive potential) of the entire toner layer increases. When the electrostatic charge enters the intensive electric field, a discharge develops in the toner layer, whereupon an upper layer portion of the toner layer is reversely charged to a negative polarity.

Figure 3A:
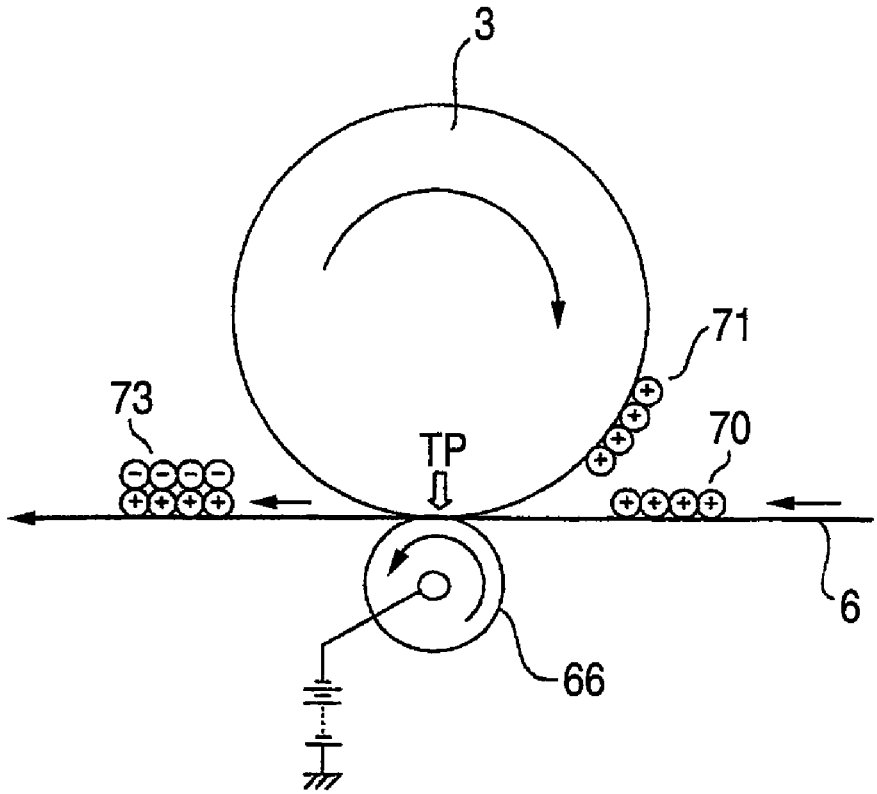
FIGS. 3A and 3B are descriptive views for describing a cause which will induce reverse charge.
Figure 3B:
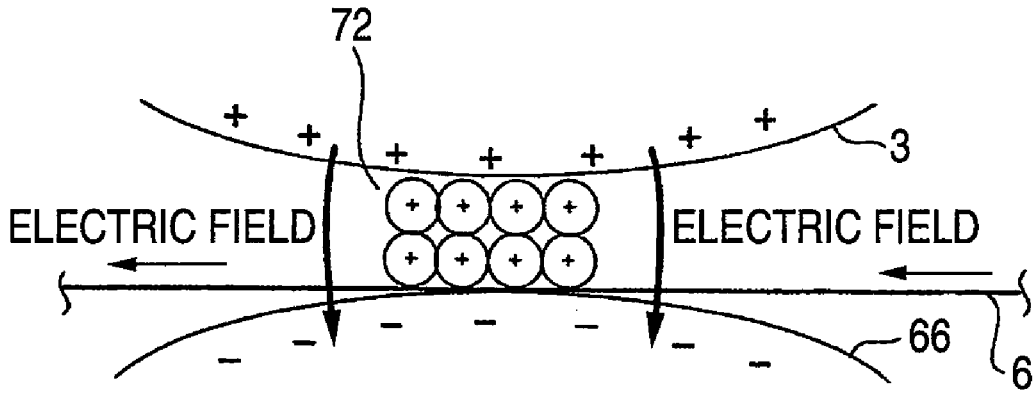

More specifically, as illustrated in FIG. 3A, a toner image (of positive polarity) 71 on the photosensitive drum 3 is transferred to become a toner image 70 of positive polarity transferred on paper (omitted from the drawing) transported leftward in the drawing by the paper transport belt 6, at the transfer nip section TP, which is a position where the photosensitive drum 3 opposes the transfer roller 66 (67, 68, 69). As a result, as shown in FIG. 3B, a layered toner image 72 is formed. When the toner image 72 departs from the transfer nip section TP, a discharge (an exfoliation discharge) develops within the toner image 72, between the surface of the photosensitive drum 3 and the transfer roller 66, under the influence of the intensive electric field. As shown in FIG. 3A, there arises a reversely-charged toner image 73, whose upper layer portion is reversely charged to a polarity (a negative polarity) opposite a normal charge polarity. Even when reverse charge has not arisen after the toner image has passed through the transfer nip section TP, there is a chance of reverse charge arising when a toner image enters the transfer position at the time of transfer of a toner image of the next color. Moreover, a test also has revealed the tendency of reverse charge becoming easy to arise with an increase in the amount of electrostatic charge of the toner image on a transfer-target material.

As shown in FIG. 4, when development is sequentially performed through use of the four development units 51M, 51C, 51Y, and 51BK assigned to four colors as in the case of the above-described embodiment, the cyan toner being formed by the development unit 51C (hereinafter called the "second development unit 51C") by which a developing-agent image is to be formed second, and superimposed on the magenta toner formed on the paper P by the development unit 51M (hereinafter called the "first development unit 51M") by which a developing-agent is to be formed first is reversely transferred to the development unit 51Y (hereinafter called the "third development unit 51Y") by which a developing agent image is to be formed third. Moreover, the cyan toner and the yellow toner which are formed by the second and third development units 51C, 51Y and superimposed on the magenta toner formed by the first development unit 51M and the yellow toner which is superimposed on the cyan toner formed by the second development unit 51C and is formed by the third development unit 51Y are reversely transferred with respect to the development unit 51BK on which a developing-agent image is to be formed fourth. Among the toner particles, the amount of the second cyan toner and the third yellow toner superimposed on the first magenta toner and reversely transferred to the fourth development unit 51BK is found to become much greater. As in the case of the present embodiment, when nonmagnetic mono-component toner which causes migration of electrostatic charges as a result of friction of toner is used, toner of inferior charging performance is charged to an opposite polarity as a result of migration of electrostatic charge, and hence particularly great influence is exerted.

3. Improvement in Toner Recovery Capability (1) Configuration for Improving Toner Recovery Capability In the present embodiment, a bias voltage is not applied directly to the respective feeding rollers 55 during normal development operation, and the feeding rollers 55 remain at essentially the same potential level as that of the respective development rollers 52. Accordingly, the respective feeding rollers 55 act as the recovery member which supplies the toner stored in the toner hopper 54 to the development rollers 52 at the nip section and scrape the toner (a waste developing agent) adhering to the surfaces of the development rollers 52 in the nip area, to thus recover the thus-scraped toner into the toner hopper 54.

In relation to the second to fourth units 51C to 51BK, which are affected by reverse transfer, a recovery bias voltage (e.g., 250 V) which is lower than the development bias voltage (400 V) supplied to the development rollers 52 opposing the development units 51C to 51BK is applied to the feeding rollers 55C to 55BK at a recovery operation timing to be described later. In contrast with the present embodiment, when toner is charged to a negative polarity, a recovery bias voltage which is higher than the development bias voltage is applied. By means of this configuration, the capability of recovering waste toner can be enhanced rather than in the normal development operation (the operation will be hereinafter called "recovery capability improvement operation").

As shown in FIG. 1, the feeding rollers 55C to 55BK of the second to fourth development units 51C to 51BK are electrically connected to the bias supply unit 11 by way of a switch 13 which is activated or deactivated by the control section 10. In accordance with the control signal output from the control section 10, the switch 13 is activated, so that the recovery bias voltage is collectively applied to the respective feeding rollers 55C to 55BK.

(2) Configuration for Estimating the Amount of Electrostatic Charge (Electrifying Capability) of Toner The above-described recovery capability improvement operation is performed when there is a chance of so-called mixing of colors or background fog arising. Occurrence of mixing of colors or background fog in the second to fourth development units 51C to 51BK is determined by a difference in charging capability of toner (cyan, yellow, and black) of the second to fourth development units 51C to 51BK and charging capability of toner of the development unit 51 located upstream of the development units 51C to 51BK (i.e., the development unit that is higher in sequence where a developing-agent image is formed).

For this reason, in the present embodiment, the control section 10 also serves as an amount-of-electrostatic-charge (charging capability) estimation unit for estimating the amount of electrostatic charge (charging capability) of respective toner particles of the first through fourth development units 51M to 51BK.

Specifically, the amount of electrostatic charge in toner of the respective development units 51 can be estimated from the value of a bias voltage applied between the photosensitive drum 3 and the development roller 52. If a superior result is obtained by correction obtained through experiments, etc.; that is, multiplying the amount of electrostatic charge by an appropriate coefficient, or adding/subtracting a certain value to/from the amount of electrostatic charge, the value of charging capability obtained by such a correction is originally desirable.

Specifically, in order to prevent deterioration of quality of an image, which would otherwise be caused by secular changes, or the like, in components of the respective development units 51 or toner, the color laser printer 1 prints a predetermined color pattern at a predetermined cycle, and performs calibration of colors on the basis of the thus-printed color pattern. The bias voltage is adjusted on the basis of the result of calibration, and hence the control section 10 estimates the amount of electrostatic charge of toner on the basis of the value of the bias voltage. In some instances, the charging capability is determined by appropriately correcting the amount of electrostatic charge. Operation for estimating the amount of electrostatic charge of toner may be performed every time an image is formed on a single sheet of paper P. However, estimation is not limited to such an operation. Estimating operation may be performed every time images are formed on a previously-determined plurality of sheets of paper.

(3) Operation for Improving Recovery Capability

In relation to each of the development units 51, the control section 10 estimates the amount of electrostatic charge (charging capability) of toner for each development unit 52 on the basis of a bias voltage applied to the photosensitive drum 3 and the development roller 52 during development. The control section 10 determines whether or not the amount of electrostatic charge of toner of at least one development unit of the second to fourth development units 51C to 51BK is smaller than the amount of electrostatic charge of toner of the upstream development unit 51 by a predetermined amount or more. On condition that the amount of electrostatic charge of toner of at least one development unit is determined to be smaller than the predetermined level or more, the chance of occurrence of mixing of colors and background fog is deemed to exist, and the switch 13 is activated. As a result, the recovery bias voltage is applied from the bias supply unit 11 to the feeding rollers 55C to 55BK of the second to fourth development units 51C to 51BK, whereby the capability of recovering waste toner is enhanced, which in turn prevents occurrence of mixing of colors or background fog.

(4) Recovery Operation Timing

Even when the difference between the amount of electrostatic charge of toner of the upstream development unit 51 and the amount of electrostatic charge of toner of the downstream development unit 51 has become greater than a predetermined level or more, an adverse effect on the quality of image formation is not necessarily exerted immediately by mixing of colors or background fog. In the embodiment, the control section 10 counts the number of sheets of paper P, on which images have been formed, from the time when the difference in the amount of electrostatic charge has exceeded a predetermined level or more. After images have been formed on only the preset number of sheets of paper P, the above-described recovery capability improvement operation is performed.

More specifically, from the time when the difference in the amount of electrostatic charge has exceeded a predetermined level or more, images are formed on, e.g., 100 sheets of paper P. Subsequently, the recovery capability improvement operation is performed once. After that, when images have been formed on 200 sheets of paper P, 300 sheets of paper P, . . . , the recovery capability improvement operation is performed. For instance, after images have been formed on a total number of 1000 sheets of paper P, the recovery capability improvement operation is no longer performed.

Toner exhibits such a tendency that toner having a larger amount of electrostatic charge (higher charging capability), such as new toner supplied immediately after exchange of toner, changes greatly with lapse of time. Accordingly, even when the difference between the amount of electrostatic charge of the upstream development unit 51 and the amount of electrostatic charge of the downstream development unit 51 is initially large, the toner having a large amount of electrostatic charge deteriorates faster than does the toner having a small amount of electrostatic charge. Hence, the difference in the amount of electrostatic charge is considered to become smaller after lapse of a certain period of time. For this reason, as mentioned previously, in the present embodiment the timings of the recovery capability improvement operation is made gradually longer in the manner of 100 sheets of paper, 200 sheets of paper, . . . After lapse of much time, the difference in the amount of electrostatic charge between the toner having a large amount of electrostatic charge and the toner having a small amount of electrostatic charge is considered to become small to such an extent that the difference does not adversely affect the quality of image formation. For this reason, as mentioned previously, subsequent recovery capability improvement operation is not performed when the total number of sheets has reached the previously-set upper limit number of sheets (e.g., 1000).

4. Advantage of the Present Embodiment (1) According to the present embodiment, the control section 10 determines whether or not the amount of electrostatic charge of the toner in at least one of the second to fourth development units 51C to 51BK is smaller than the amount of electrostatic charge of toner of a development unit 51 upstream of that development unit by a predetermined amount or more. On condition that the amount of electrostatic charge of the development unit is determined to be smaller than the predetermined amount of electrostatic charge, there is performed recovery capability improvement operation for applying a recovery bias voltage from the bias supply unit 11 to the feeding rollers 55C to 55BK of the second to fourth development units 51C to 51BK. As a result, the second to fourth development units 51C to 51BK, which may otherwise cause mixing of colors or background fog by reverse transfer, are enhanced in view of the capability of recovering waste toner, which in turn prevents occurrence of mixing of colors or background fog.

(2) In the present embodiment, timing of recovery capability improvement operation is gradually made longer at, for example, the end of formation of images on 100 sheets of paper P, the end of formation of images on 200 sheets of paper P, . . . A difference between the amount of electrostatic charge of the upstream development unit 51 and the amount of electrostatic charge of the downstream development unit 51 tends to become smaller with lapse of time. For this reason, performance of useless recovery capability improvement operation is prevented by gradually extending the timing of recovery capability improvement operation.

(3) After lapse of an additional time, the difference between the amount of electrostatic charge of the upstream development unit and the amount of electrostatic charge of the downstream development unit is considered to become smaller to such an extent as not to adversely affect the quality of image formation. For this reason, the recovery capability improvement operation is not performed at a point in time when the total number of sheets of paper has reached the preset upper limit number of sheets (a preset number of sheets; e.g., 1000).

Second Embodiment

Figure 5A:
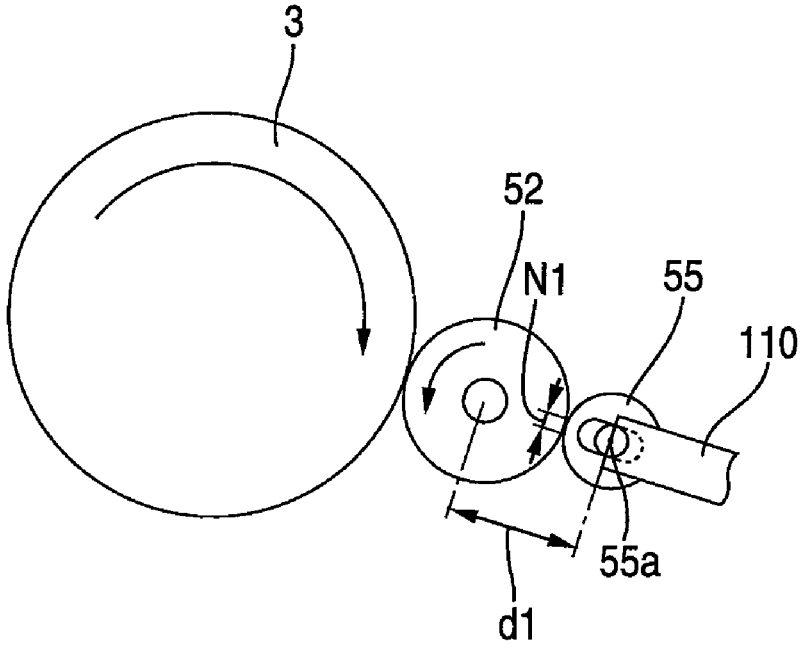
FIGS. 5A and 5B are schematic views for describing a nip width in a second embodiment of the present invention.
Figure 5B:
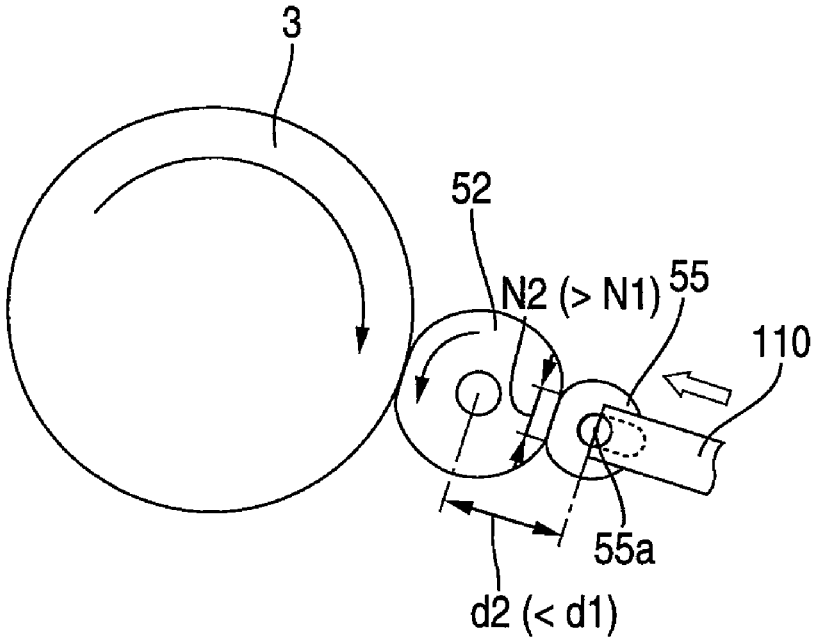
Figure 6:
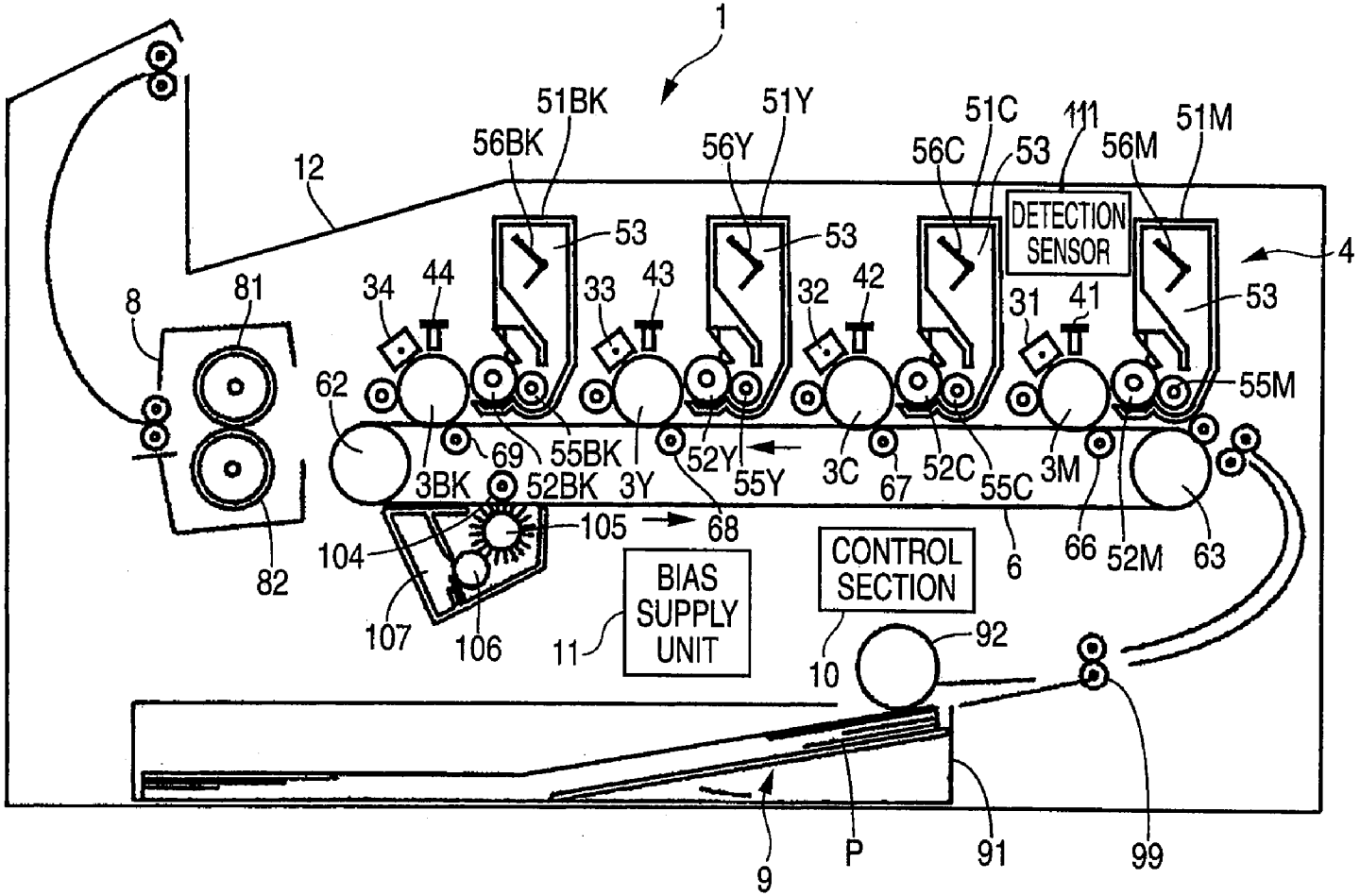
FIG. 6 is a side cross-sectional view showing the schematic configuration of a color laser printer.

FIGS. 5 and 6 show a second embodiment. A difference between the first and second embodiments lies in the method for improving recovery capability and a method for determining whether or not the recovery capability improvement operation is to be performed. In other respects, the second embodiment is analogous to the first embodiment. Consequently, those reference numerals which are the same as those of the first embodiment are assigned to elements of the second embodiment, and their repeated explanations are omitted. Only a difference between the first and second embodiments will now be described.

In the embodiment, recovery capability is changed by changing a nip width N (a contact width of the feeding roller 55 in the rotational direction thereof) where the development roller 52 and the feeding roller 55 come in contact with each other. Specifically, as shown in FIG. 5, the rotary shafts 55*a* of the respective feeding rollers 55C to 55BK are supported by the development unit cases 53 so as to be movable along a direction in which the feeding rollers 55C to 55BK and the development rollers 52C to 52BK oppose each other. A press mechanism 110 for pressing both ends of the respective rotary shafts 55*a* of the feeding rollers 55C to 55BK in a direction towards the respective development rollers 52M to 52BK is provided outside the development unit cases 53 or the development units 51.

As shown in FIG. 6, the control section 10 is designed to receive a detection signal output from a detection sensor 111 that detects replacement of toner of any of the development units 51. On condition that the control section 10 has received the detection signal, the control section 10 activates the press mechanism 110 at the same timing as that in the first embodiment. Thus, the feeding rollers 55C to 55BK of the second to fourth development units 51C to 51BK are displaced from the state shown in FIG. 5A to the state shown in FIG. 5B. As a result, the distance between the shafts of the feeding rollers 55C to 55BK and the shafts of the development rollers 52C to 52BK becomes shorter, from d1 to d2, in the second to fourth development units 51C to 51BK. In association with this reduction in distance, the nip width becomes broader from N1 to N2. Specifically, the feeding rollers 55C to 55BK and the development rollers 52C to 52BK come into tighter frictional contact with each other than before performance of the toner recovery improvement operation, thereby improving the capability for recovering toner.

Other Embodiments

The present invention is not limited to the embodiments described by reference to the above descriptions and the drawings. For instance, embodiments provided below fall within the technical scope of the present invention, and can be carried out while being modified in various manners while remaining within the scope of the invention.

(1) In the respective embodiments, development is performed in sequence of magenta, cyan, yellow, and black. The sequence of formation of a developing-agent image (sequence of arrangement of developing-agent images) other than that mentioned above may also be adopted.

(2) The respective embodiments have mentioned an example of development of four colors; namely, magenta, cyan, yellow, and black. However, the development is not limited to four colors. Development of seven colors made by adding three colors; red, green, and blue, to the aforementioned four colors, may also be adopted. Moreover, for instance, the present invention can be applied to development of two colors; that is, red toner and black toner, or development of six colors.

(3) In addition to being embodied by the configurations of the respective embodiments, the method for improving recovery capability may be embodied by a configuration for increasing the rotational speed (the number of revolutions per unit time) of the feeding rollers 55C to 55BK (rotators) in relation to that achieved during ordinary image forming operation.

(4) In the respective embodiments, the recovery capability improvement operation is performed by all of the second to fourth development units 51C to 51BK. However, the present invention is not limited to this configuration. For instance, there may also be employed a configuration for performing recovery capability improvement operation in connection with the third and fourth development units 51Y, 51BK which reversely rotate over distances, or in connection with only the fourth development unit 51BK. Alternatively, there may also be employed a configuration for performing recovery capability improvement operation in connection with the development unit 51 which has become lower in electrostatic charge than the upstream development unit 51 by a predetermined level or more, or in connection with only a development unit 51 downstream of the development unit 51 whose toner has been exchanged.

Figure 7:
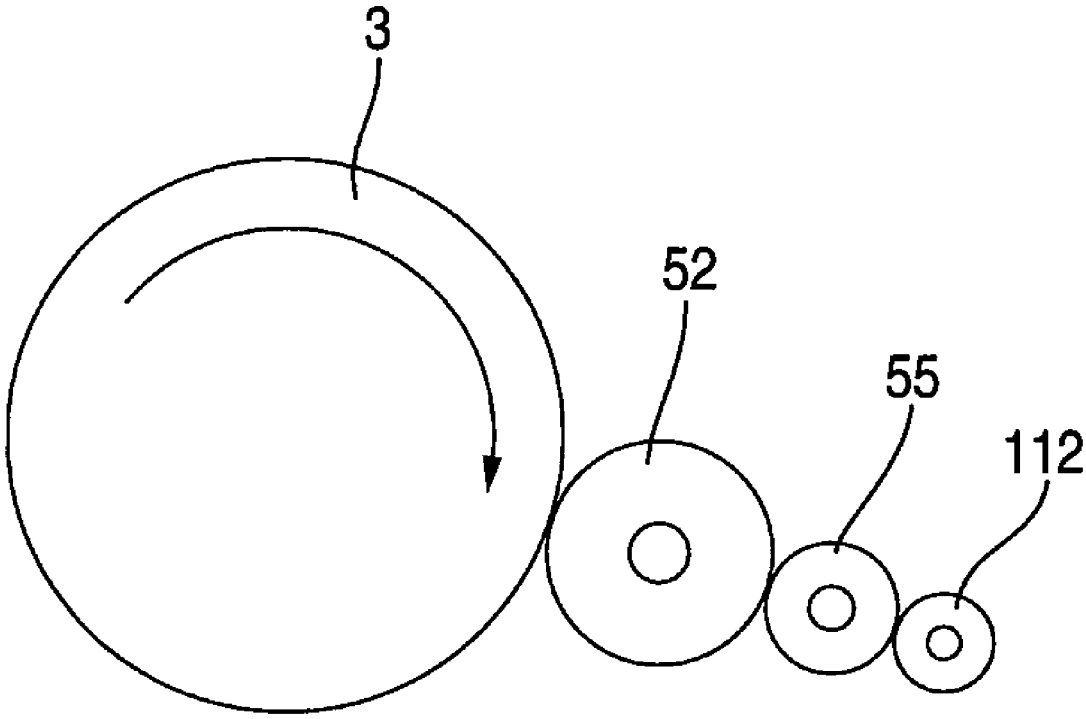
FIG. 7 is a schematic view showing a modification.

(5) As shown in FIG. 7, in the respective embodiments, a secondary recovery roller 112 which comes into contact with the feeding roller 55 may be provided, thereby realizing a configuration for scraping the waste toner adhering to the feeding roller 55 with the secondary recovery roller 112. At this time, a secondary recovery bias voltage for recovering the waste toner adhering to the feeding roller 55 is applied to the secondary recovery roller 112. More specifically, in the above-described embodiments, a bias voltage (e.g., 100 V) lower than the recovery bias voltage applied to the feeding roller 55 is applied to the secondary recovery roller 112.

(6) The above-described embodiments have described the image forming apparatus using a so-called "direct transfer system," wherein a visible image (an image formed by a developing agent) formed on the photosensitive drum 3 is transferred directly onto the paper P which is taken as a transfer-target material. However, the present invention is not limited to this transfer system. For instance, there may also be employed an image forming apparatus of so-called "intermediate transfer system," wherein an intermediate transfer element, such as an intermediate transfer belt or an intermediate transfer drum, is taken as a transfer-target material; a visible image formed on a photosensitive drum is transferred to the intermediate transfer element (through primary transfer operation); and the image is further transferred to paper (a recording medium) from the intermediate transfer element (through secondary transfer operation). As a matter of course, the present invention can also be applied to a four-cycle system, as well as to a tandem system.

Third Embodiment

Figure 8:
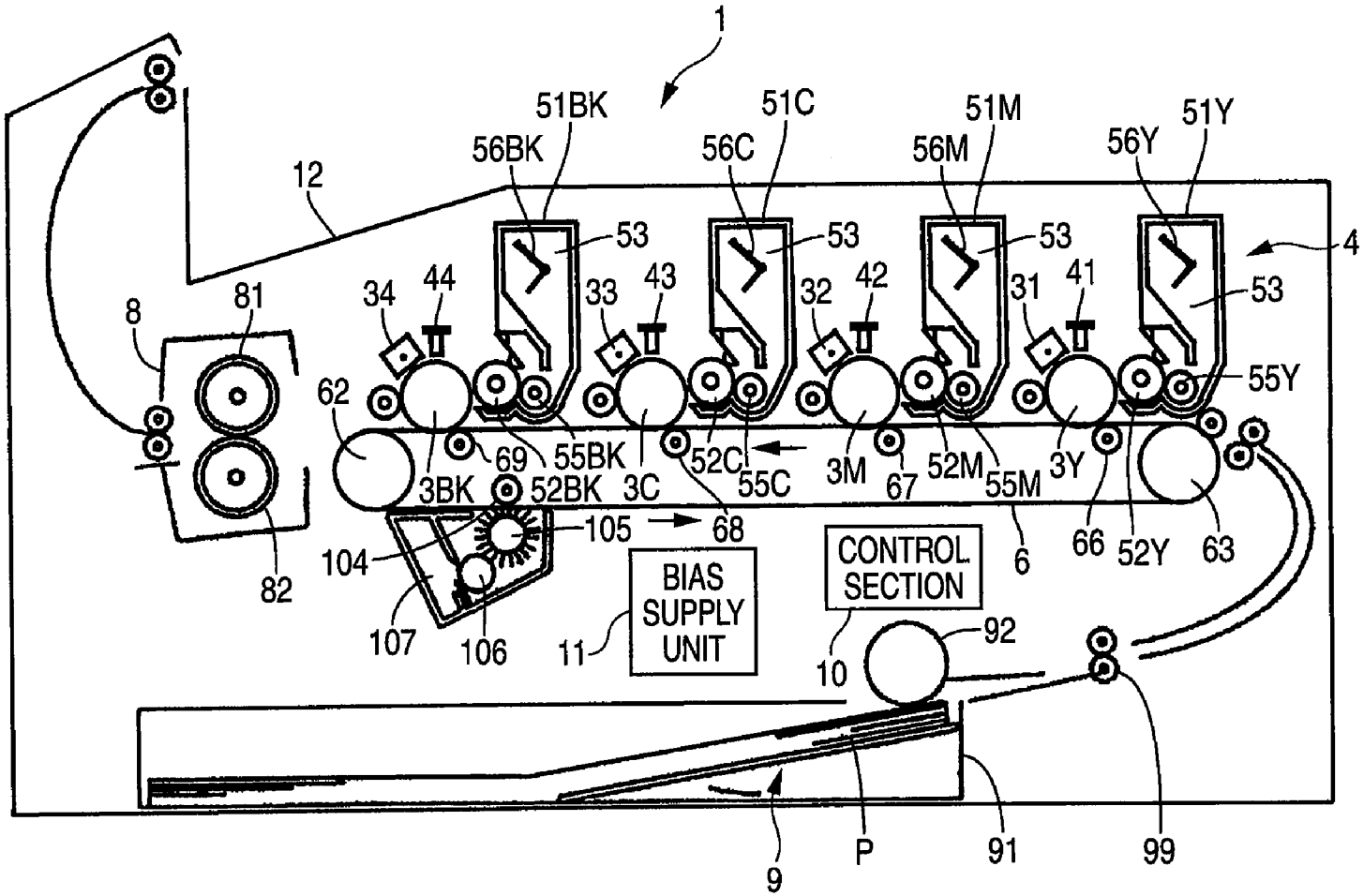
FIG. 8 is a side cross-sectional view showing a diagrammatic configuration of a color laser printer according to a third embodiment of the present invention.

FIG. 8 is a side cross-sectional view showing a diagrammatic configuration of a color laser printer 1 according to a third embodiment.

In this embodiment, bias voltages (400 V) of essentially the same levels are applied to the respective development rollers 52 and the respective feeding rollers 55. Accordingly, the respective feeding rollers 55 supply the toner held in the toner hopper 54 to the development rollers 52 in the nip sections, as well as functioning as the recovery unit which scrape the toner (the waste developing agent) adhering to the surface of the development roller 52 to thus recover the toner into the toner hopper 54.

In the embodiment, the respective feeding rollers 55 are columnar bodies of the same diameter. The rotational speed (the number of revolutions per unit time) of the feeding roller BK of the fourth development unit 51BK is faster than the rotational speeds of the feeding rollers 55Y to 55C of the first to third development units 51Y to 51C. Specifically, the toner recovery capability of the fourth development unit 51BK is set higher than the toner recovery capabilities of the other development units 51Y to 51C.

In the configuration in which the developing agent (the waste developing agent) adhering to the developing-agent carrier is recovered by use of a rotatable element (the "feeding roller") which revolves while remaining in slidable contact with the developing-agent carrier, the recovery capability becomes greater as the circumferential speed (the moving speed of an outer peripheral surface per unit time) of the rotatable element becomes faster. When the rotatable elements have the same diameter, the circumferential speeds; i.e., the recovery capabilities, can be made different from each other by changing rotational speeds (the numbers of revolution per unit time) of the respective rotatable elements. As long as the rotatable elements have different diameters, the circumferential speeds; i.e., the recovery capabilities, can be made different from each other, at the same rotational speed.

In a configuration for recovering the developing agent (the waste developing agent) adhering to the developing-agent carrier by use of a contact element (may be a rotary contact element which rotates while remaining in contact with the developing-agent carrier (the "feeding roller") which comes into slidable contact with the developing-agent carrier; the developing-agent carrier and the contact body harshly rub against each other as the hardness of the contact section of the contact body is higher, thereby enhancing recovery capability. For this reason, in this configuration, the hardness of the contact body in each development unit is adjusted; namely, the hardness of the contact body of each development unit is changed according to desired recovery capability.

In a configuration for recovering the developing agent (the waste developing agent) adhering to the developing-agent carrier by use of a contact element (may be a rotary contact body which rotates while remaining in contact with the developing-agent carrier (the "feeding roller") which comes into slidable contact with the developing-agent carrier; the developing-agent carrier and the contact body also harshly rub against each other as a contact width (a nip width), in the moving direction of the contact body, between the contact body and the developing-agent carrier becomes wider, thereby enhancing recovery capabilities. Therefore, in this configuration, the contact width of each development unit is adjusted; namely, the contact width of each development unit is changed according to desired recovery capability.

In the case of, e.g., a developing agent having a positive polarity, the capability of a feeding roller for recovering a developing agent can be suppressed by increasing a supply bias voltage so as to become higher than a development bias voltage. Conversely, in the case of a developing agent having a negative polarity, the recovery capability of the feeding roller can be suppressed by making the supply bias voltage so as to make the same lower than the development bias voltage.

Accordingly, in this configuration, the configurations are implemented by adjusting the amount of the development bias voltage relative to the amount of the supply bias voltage in each development unit.

In the present embodiment, all of agitators 56Y, 56M, 56C, and 56BK, which are rotated within the toner hoppers 54 to agitate the toner in the toner hoppers 54, assume the same shape and size. The rotational speed (the number of revolutions per unit time) of the agitator 56BK of the fourth development unit 51BK is faster than the rotational speeds of the agitators 56Y to 56C of the first to third development units 51Y to 51C. Specifically, the toner agitation capability of the fourth development unit 51BK is set higher than the toner agitation capabilities of the other development units 51Y to 51C.

According to the embodiment, the toner recovery capability of the fourth development unit 51BK is set so as to become higher than those of the other development units 51Y to 51C. As a result, the fourth development unit 51BK, which is subjected to the largest amount of reverse transfer, for recovering waste toner from the development roller 52BK has improved toner removal capability as compared with the other development units 51Y to 51C, thereby suppressing occurrence of mixing of colors or fog.

Moreover, the toner agitation capability of the fourth development unit 51BK is set so as to become higher than those of the other development units 51Y to 51C. As a result, the agitator 56BK of the fourth development unit 51BK, which is subjected to the largest amount of reverse transfer, has improved agitation capability in comparison with the agitators of the other development units 51Y to 51C. As a result, the reversely-transferred toner is efficiently dispersed within the toner hopper 53, thereby effectively preventing occurrence of fog.

The development unit which effects development with black toner undergoes less influence of mixing of toner of other colors. For this reason, in the present embodiment, the fourth development unit 51BK is assigned to development involving use of black toner. As a result, deterioration of image quality can be effectively prevented.

Fourth Embodiment

Figure 9:
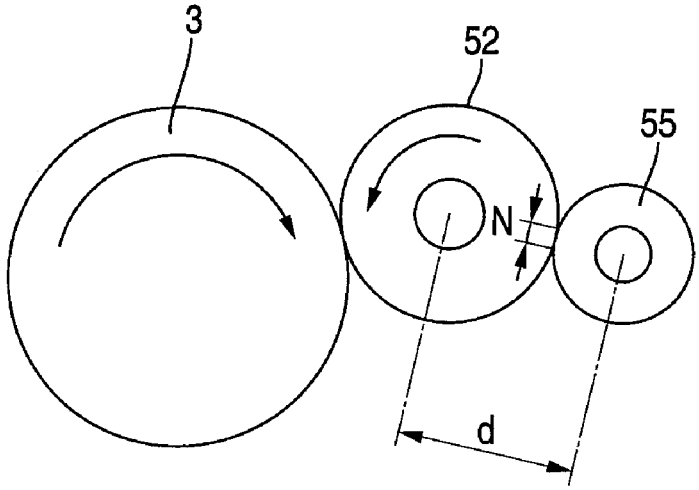
FIG. 9 shows a fourth embodiment of the present invention.

FIG. 9 shows a fourth embodiment. A difference between the fourth embodiment and the third embodiment lies in a method for changing recovery capability. In other respects, the fourth embodiment is the same as the third embodiment. Accordingly, those reference numerals which are the same as those in the first embodiment denote identical elements, and their repeated explanations are omitted. Explanation is given herein below solely to different elements.

In the present embodiment, the recovery capability is changed by changing the nip width N (the contact width in the rotating direction of the feeding roller 55) along which the development roller 52 and the feeding roller 55 contact each other. Specifically, as FIG. 5, in relation to a distance "d" between the rotary shaft of the development roller 52 and the rotary shaft of the feeding roller 55, the fourth development unit 51BK is shorter than the first to third development units 51Y to 51C. As a result, the nip width N of the fourth development unit 51BK is made wider than those of the other development units 51Y to 51C.

By means of such a configuration, in the fourth development unit 51BK, the development roller 52BK and the feeding roller 55BK rub against each other with more force than do the other development units 51Y to 51C. Hence, the recovery capabilities can be improved. By means of the configuration of the present embodiment, there is yielded an advantage of the ability to readily change recovery capability by changing the distance "d" between the shaft of the development roller 52 and that of the feeding roller 55 without changing the material and rotational speed of the roller portion of the feeding roller 55.

Fifth Embodiment

Figure 10:
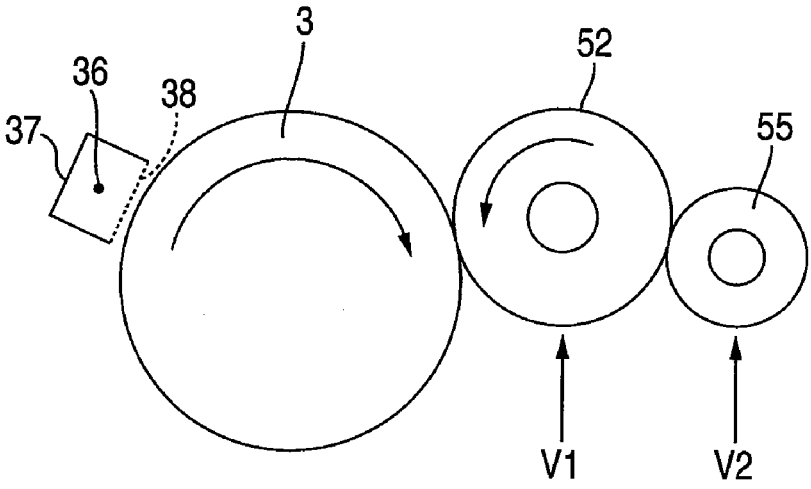
FIG. 10 shows a fifth embodiment of the present invention.

FIG. 10 shows a fifth embodiment. A difference between the fifth embodiment and the third embodiment lies in a method for changing recovery capability. In other respects, the fifth embodiment is analogous to the third embodiment. Consequently, those reference numerals which are identical with those in the third embodiment denote identical elements, and their repeated explanations are omitted. Explanation is given herein below solely to different elements.

Like the present embodiment, when toner has a positive polarity, a supply bias voltage V1 fed to the feeding roller 55 from the bias supply unit 11 is made higher than a development bias voltage V2 fed to the development roller 52, thereby suppressing the capability of the feeding roller 55 for recovering toner.

As shown in FIG. 10, in relation to the fourth development unit 51BK, the supply bias voltage V1 is made substantially equal to the development bias voltage V2; for instance, +400 V, whereby the feeding roller 55BK supplies toner to the development roller 52BK and recovers waste toner. Meanwhile, in relation to the first to third development units 51Y to 51C, the supply bias voltage V1 is made higher than the development bias voltage V2; e.g., +500 V, so that the feeding rollers 55Y, 55M, and 55C supply toner but do not recover waste toner.

Even in the case of such a configuration, the same advantage as that yielded in the third embodiment can be yielded.

Sixth Embodiment

Figure 11:
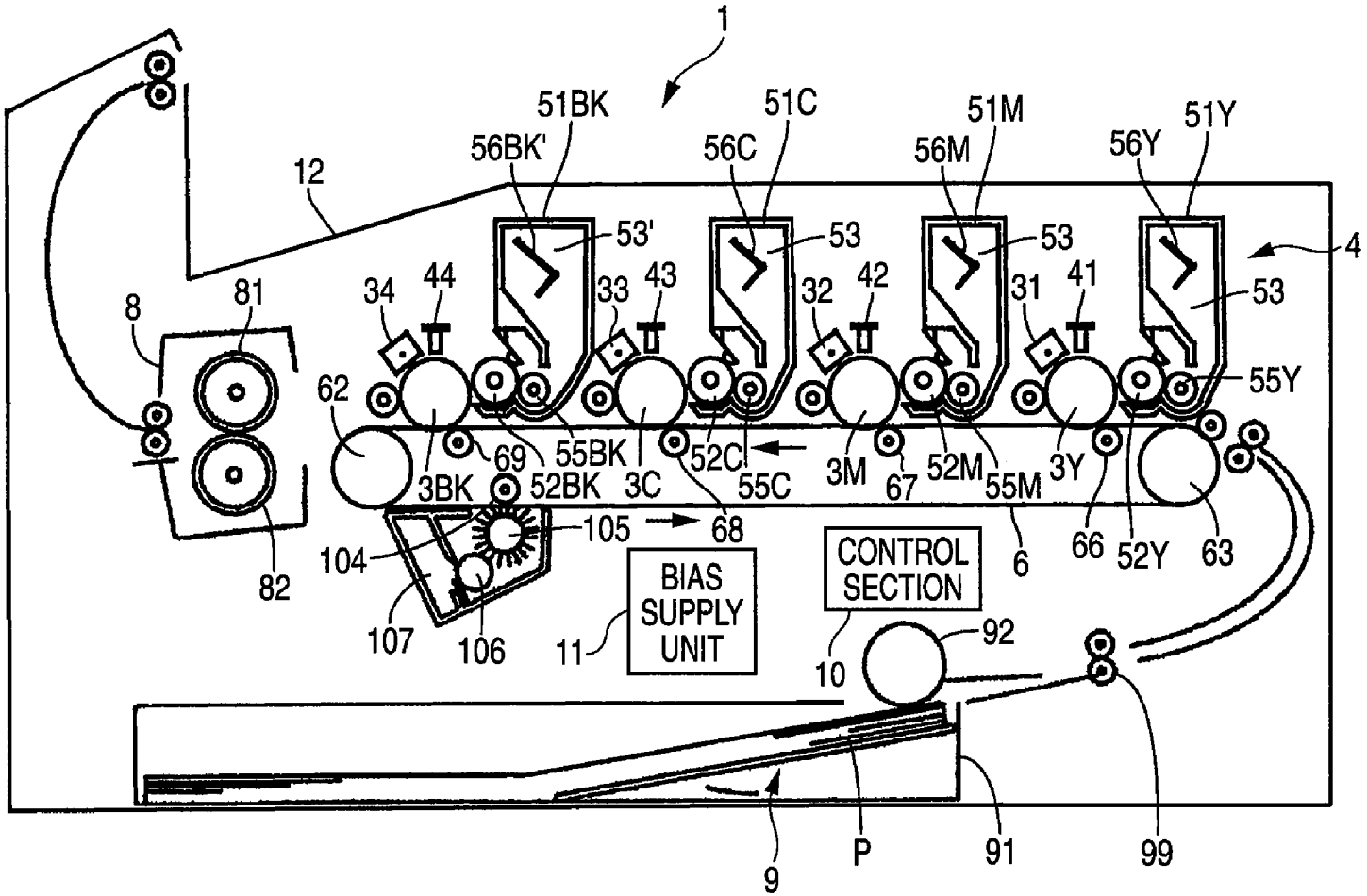
FIG. 11 shows a sixth embodiment of the present invention.

FIG. 11 shows a sixth embodiment. A difference between the third and sixth embodiments lies in the configuration of the toner hopper section of the fourth development unit 51BK. In other respects, the sixth embodiment is analogous to the third embodiment. Accordingly, those reference numerals which are the same as those in the third embodiment denote identical elements, and their repeated explanations are omitted. Explanation is given herein below solely to different elements.

As shown in FIG. 11, in the present embodiment, a toner hopper 53' of the fourth development unit 51BK is greater in volume for storing toner than the toner hoppers of the other development units 51Y to 51C, and can store a large amount of black toner. An agitator 56BK' rotatably provided in the toner hopper 53' also can agitate a greater amount of toner than can agitators of the other development units 51Y to 51C.

Here, black toner is also used for forming a monochrome image, and hence is required in larger quantity than is toner of the other colors. For this reason, in the present embodiment, the toner hopper 53' of the fourth development unit 51BK for development of black color is made so as to be able to store a larger amount of black toner than are the toner hoppers of the other development units 51Y to 51C. The fourth development unit 51BK, which is subjected to the largest amount of reverse transfer, is enhanced in agitation capability of the agitator 56BK so as to attain much greater agitation capabilities than the agitators of the other development units 51Y to 51C. Thus, the reversely-transferred toner is efficiently dispersed within the toner hopper 53, thereby preventing occurrence of fog or mixing of colors.

Other Embodiments

The present invention is not limited to the embodiments described by the above descriptions and drawings. For instance, embodiments provided below also fall within the technical scope of the present invention, and the present invention can be carried out in various forms within the range of the gist of the present invention.

(1) In the third through sixth embodiments, the recovery capability of the fourth development unit 51BK is set so as to become higher than the recovery capabilities of the other development units 51Y to 51C. However, the present invention is not limited to these embodiments. For instance, there may also be adopted a configuration wherein a development unit which is later in sequence of formation of a developing-agent image has a higher recovery capability. In addition, there may also be adopted a configuration wherein the second to fourth development units 51M to 51BK are made higher in recovery capability than the first development unit 51Y. Alternatively, there may also be adopted a configuration wherein the third and fourth development units 51C, 51BK are made higher in recovery capability than the first and second development units 51Y, 51M.

(2) In the third through sixth embodiments, the agitation capability of the fourth development unit 51BK is set so as to become higher than those of the other development units 51Y to 51C. The present invention is not limited to these embodiments. For instance, there may also be adopted a configuration wherein a development unit which is later in sequence of formation of a developing-agent image has a higher agitation capability. In addition, there may also be adopted a configuration, wherein the second to fourth development units 51M to 51BK are made higher in agitation capability than the first development unit 51Y. Alternatively, there may also be adopted a configuration wherein the third and fourth development units 51C, 51BK are made higher in agitation capability than the first, second development units 51Y, 51M.

(3) In the configuration of the third embodiment, the feeding roller 55BK is made faster in rotation speed than the other feeding rollers 55Y to 55C, thereby changing recovery capabilities. However, the present invention is not limited to these embodiments. There may be adopted a configuration wherein a recovery capability is changed by adjusting the hardness of the roller portion of the feeding roller 55. For instance, the roller portion of the feeding roller 55BK is made of a material which is harder than the materials of the other feeding rollers 55Y to 55C. More specifically, urethane foam having a hardness of 70±5° (ASKER F hardness) is used for the feeding rollers 55Y to 55C, and sponge material or resin coating, which is harder than the urethane foam, is applied to the feeding roller 55BK.

(4) In the third to sixth embodiments, there may also be adopted a configuration of changing levels of the yellow, magenta, cyan, and black development units 51 in terms of sequence of formation of a developing-agent image; namely, the sequence of arrangement of the development units in the transport direction of paper P. As mentioned above, the fourth development unit is preferably assigned to development of black color, in consideration of the influence of mixing of colors or fog.

(5) The third through sixth embodiments have provided examples of development of four colors; namely, yellow, magenta, cyan, and black. However, the development is not limited to four colors. The may also be adopted development of seven colors made by adding three colors; red, green, and blue, to the aforementioned four colors. Moreover, for instance, the present invention can be applied to development of two colors; that is, red toner and black toner, or development of six colors.

(6) In the above embodiments, the feeding rollers 55, which also play the role of feeding toner to the development rollers 52, are employed as the recovery unit. However, the recovery unit is not limited to these feeding rollers. Another body of revolution or a moving body, which come into contact with the development rollers 52, may also be employed.

(7) The third through sixth embodiments have adopted the synchronous development-and-cleaning system. However, in addition to this system, another system having a cleaning mechanism which recovers waste toner and is separately provided around the photosensitive drum 3 may also be adopted. For example, when the above-described cleaning mechanism fails to sufficiently recover waste toner for reasons of deterioration of operation of the cleaning mechanism, such a cleaning mechanism is useful.

Further, instead of the feeding roller that serves as a contact element, a plate, such as a blade, to be pressed against the developing-agent carrier may be employed. In this case, the contact width can be changed by changing the pressure used for pressing the blade.

When the contact element corresponds to a rotary contact element which rotates while remaining in contact with a developing-agent carrier, a configuration for changing the contact width includes, e.g., the following configurations:

(A) A configuration in which diameters of rotary contact elements of the respective development units are made identical with each other, while producing differences in distances between the rotary center shafts of the rotary contact elements and the surface of the developing-agent carriers.

(B) A configuration in which distances from the rotary center shafts of the rotary contact elements of the respective development units and surfaces of the developing-agent carriers are made equal to each other, while producing differences in the diameters of the rotary contact elements.

(C) A configuration of making different a ratio of "the distance between the rotary center shaft of the rotary contact element and the developing-agent carrier" to "the diameter of the rotary contact element."

The combination of either of the first and second embodiments and at least either of the third to sixth embodiments constitute the best mode of the present invention.

What is claimed is:

1. An image forming apparatus comprising:

image carriers, on whose surfaces electrostatic latent images are formed;

a plurality of development units which are provided in correspondence to different colors, which have developing-agent carriers that carry developing agents of corresponding colors, and which develop the electrostatic latent images on the surfaces of the image carriers through use of the developing agents by the developing-agent carriers; and recovery units which are provided for the respective development units and which recover the developing agents adhering to the respective developing-agent carriers upon contact with the developing-agent carriers after the image carriers have been subjected to development, wherein developing-agent images are sequentially formed on the image carriers by developing the electrostatic latent images by the respective development units, and the developing-agent images are transferred to a transfer-target material, thereby forming a multi-color image, and recovery capabilities of the respective recovery units are determined such that the development unit which is last in sequence of formation of a developing-agent image is higher in recovery capability than at least the development unit which is first in sequence of formation of the developing-agent image, and such that recovery capability of one development unit is higher than recovery capability of another development unit which is immediately before the one development unit in sequence of formation of the developing-agent image.

2. The image forming apparatus according to claim 1, wherein recovery capabilities of the respective recovery unit are determined such that the development unit, which is second to last in sequence of formation of the developing-agent image, is higher in recovery capability than the development unit which is first in sequence of formation of the developing-agent image.

3. The image forming apparatus according to claim 1, wherein recovery capabilities of the respective recovery units are determined such that the development unit, which is last in sequence of formation of the developing-agent image, is higher in recovery capability than the development unit other than the development unit that is last in sequence.

4. The image forming apparatus according to claim 1, wherein recovery capabilities of the respective recovery units are determined such that the development unit, which is third to last in sequence of formation of the developing-agent image, is higher in recovery capability than the development unit which is first or second in sequence of formation of the developing-agent image.

5. The image forming apparatus according to claim 1, wherein each of the recovery units comprises a rotatable element which recovers the developing agent adhering to the developing-agent carrier when rotating while remaining in contact with the developing-agent carrier, and a circumferential speed of the rotatable element of the development unit whose recovery capability is to be improved is faster than that of the other development unit.

6. The image forming apparatus according to claim 5, wherein the rotatable element is a feeding roller which rotates while remaining in contact with the developing-agent carrier and supplies to the developing-agent carrier the developing agent stored in a developing-agent storage chamber of the development unit.

7. The image forming apparatus according to claim 1, wherein the respective recovery units are contact elements which recover the developing agents adhering to the developing-agent carriers by relative movement while remaining in contact with the respective developing-agent carriers, and hardness of the contact elements of the development unit whose recovery capability is to be improved is higher than that of the other development unit.

8. The image forming apparatus according to claim 7, wherein the contact elements are feeding rollers which rotate while remaining in contact with the developing-agent carriers and feed to the developing-agent carriers developing agents in developing-agent storage chambers of the development units.

9. The image forming apparatus according to claim 1, wherein the respective recovery units are contact elements which recover the developing agents adhering to the developing-agent carriers by relative movement while remaining in contact with the respective developing-agent carriers, and a contact width between the contact element and the developing-agent carrier is wider in the development unit whose recovery capability is to be improved than that of other development unit.

10. The image forming apparatus according to claim 1, wherein each of the recovery unit is a feeding roller which rotates while remaining in contact with the respective developing-agent carrier; which feeds to the developing-agent carrier the developing agent in a developing-agent storage chamber of the development unit; and which recovers the developing agent adhering to the developing-agent carrier; and the image forming apparatus further comprises a development bias application unit for applying a development bias voltage to each of the developing-agent carriers, and a supply bias application unit for applying a supply bias voltage to each of the feeding rollers, wherein recovery capability of each of the development units is determined on the basis of the relationship between the supply bias voltage and the development bias voltage.

11. The image forming apparatus according to claim 1, further comprising:

an agitation member provided to each of the development units, for agitating the developing agent in a developing-agent storage chamber that stores the developing agent, wherein agitation capabilities of the respective agitation members are determined such that the development unit which is last in sequence of formation of a developing-agent image is higher in agitation capability than at least the development unit which is first in sequence of formation of the developing-agent image and such that one development unit is higher in agitation capability than another development unit which is immediately before the one development unit in sequence of formation of the developing-agent image.

12. The image forming apparatus according to claim 1, wherein the development unit which is last in sequence of formation of the developing-agent image is configured such that the developing-agent carrier carries a black developing agent, and such that an electrostatic latent image is developed by the black developing agent.

* * * * *